US007178843B2

(12) United States Patent
Askinasi

(10) Patent No.: US 7,178,843 B2
(45) Date of Patent: Feb. 20, 2007

(54) LITTER AND REFUSE RETRIEVAL DEVICE

(75) Inventor: Barry Askinasi, Mt. Sinai, NY (US)

(73) Assignee: Four Paws Products, Ltd., Hauppauge, NY (US)

( * ) Notice: Subject to any disclaimer, the term of this patent is extended or adjusted under 35 U.S.C. 154(b) by 0 days.

(21) Appl. No.: 10/693,826

(22) Filed: Oct. 23, 2003

(65) Prior Publication Data

US 2004/0130169 A1 Jul. 8, 2004

Related U.S. Application Data

(60) Provisional application No. 60/420,497, filed on Oct. 23, 2002.

(51) Int. Cl.
*A01K 29/00* (2006.01)
*E01H 1/12* (2006.01)

(52) U.S. Cl. ..... 294/1.4; 294/115; 403/326

(58) Field of Classification Search ..... 294/1.3, 294/1.4, 1.5, 19.1; 403/326, 329, 339, 340; 24/604, 605, 607, 612, 614–616, 625; 16/422, 16/423, 429; 15/104.8, 257.1, 257.6
See application file for complete search history.

(56) References Cited

U.S. PATENT DOCUMENTS

| | | | | |
|---|---|---|---|---|
| 652,077 | A * | 6/1900 | Burson | 294/50.8 |
| 3,738,697 | A * | 6/1973 | Kahan | 294/1.4 |
| 4,005,897 | A * | 2/1977 | Smith | 294/19.1 |
| 4,247,139 | A * | 1/1981 | Grieb | 294/1.4 |
| 4,248,468 | A * | 2/1981 | Hastings | 294/1.4 |
| 4,854,626 | A * | 8/1989 | Duke | 294/19.1 |
| 5,503,442 | A * | 4/1996 | Lee | 294/1.4 |
| 5,507,076 | A * | 4/1996 | Anscher | 24/625 |
| 5,601,321 | A * | 2/1997 | Simon | 294/1.4 |
| 5,668,521 | A * | 9/1997 | Oh | 337/186 |
| 6,530,133 | B2 * | 3/2003 | Meyrat et al. | 24/615 |
| 6,557,212 | B2 * | 5/2003 | Huang | 16/422 |

FOREIGN PATENT DOCUMENTS

| | | | | |
|---|---|---|---|---|
| GB | 2185434 | * | 7/1987 | 294/1.4 |

* cited by examiner

*Primary Examiner*—Kathy Matecki
*Assistant Examiner*—Paul T. Chin
(74) *Attorney, Agent, or Firm*—Darby & Darby

(57) ABSTRACT

A litter and refuse retrieval device is provided for sanitarily and single-handedly cleaning up after a pet. The device includes an outer frame having an upper and a lower portion and an inner frame also having an upper and a lower portion. The upper and lower portions of the respective frames can be connected together to form the assembled retrieval device by interlocking prongs with respective prong receiving openings. The device further includes an outer frame having a handle at one end and outer nipples at the other end for pivotally mounting two scoops. Each scoop includes extended disk portions with holes therethrough that overlap with the disk portions of the other scoop placing the holes in alignment for insertion of the outer nipples of the outer frame. An inner control frame is carried by the outer frame and includes linkage arms having outwardly extending cylindrical portions having nipples extending therefrom for pivotally mounting the two scoops adjacent to the outer nipples. In operation, the inner control frame is squeezed by the user toward a stop potion of the outer frame, causing the scoops to pivot in opposite directions. Also provided is a spring biasing mechanism for closing the scoops after the user has released the inner control frame.

7 Claims, 1 Drawing Sheet

LITTER AND REFUSE RETRIEVAL DEVICE

The present application claims the benefit of U.S. patent application No. 60/420,497, filed Oct. 23, 2002, which is hereby incorporated by reference in its entirety.

FIELD OF THE INVENTION

The present invention relates to a litter and refuse retrieval device. In particular, the present invention relates to a hand activated spring biased "pooper scooper" of the type disclosed in U.S. Pat. No. 5,601,321 which is incorporated herein by reference.

BACKGROUND OF THE INVENTION

Pet refuse left on a sidewalk or on a street causes sanitary problems, particularly in large urban areas. Many cities have enacted local ordinances requiring that the pet owner clean up after their pets. Such a task is not only unpleasant to perform but may be difficult to perform at the same time as holding a dog by a leash. Further, since it would be extremely inconvenient to have a device failure in mid-clean up, the device must be strongly constructed, yet must be inexpensive to manufacture and package for the consumer. Therefore, there is a need to provide a device, requiring only single-handed operation, for cleaning up after a pet in a sanitary fashion that is also easily assembled and packaged.

U.S. Pat. No. 4,248,468 to Hastings discloses one such device. The Hastings patent discloses a litter retrieval apparatus formed of an elongated unitary plastic frame having a handle section at one end, scoop-supporting arms at the other end, and an elongated central section having a passageway for receiving a control rod. The control rod extends through the passageway from the handle to the scoops. Linkages connect the lower end of the control rod to the scoops and spring biasing means are provided for biasing the scoops in a closed position. While most of the device can be cheaply made of molded plastic, the patent discloses that the control rod is made of metal, therefore increasing the cost of such a device. Since the control rod is narrow and extends down the length of the handle, it appears that it must be made of metal or another very strong material.

It is an object of the invention to provide an apparatus for retrieving litter that requires only one-handed operation that is strong and reliable yet is also inexpensive to manufacture and package.

SUMMARY OF THE INVENTION

A litter and refuse retrieval device is provided for sanitarily and single-handedly cleaning up after a pet. The device includes an outer frame having an upper and a lower portion and an inner frame having an upper and a lower portion. The upper and lower portions of the respective frames can be connected together to form the assembled retrieval device by interlocking prongs with prong receiving openings. The device further includes an outer frame having a handle at one end and outer nipples at the other end for pivotally mounting two scoops. Each scoop includes extended disk portions with holes therethrough that overlap with the disk portions of the other scoop placing the holes in alignment for insertion of the outer nipples of the outer frame. An inner control frame is carried by the outer frame and includes linkage arms having outwardly extending cylindrical portions having nipples extending therefrom for pivotally mounting the two scoops adjacent to the outer nipples. In operation, the inner control frame is squeezed by the user toward a stop potion of the outer frame, causing the scoops to pivot in opposite directions. Also provided is a spring biasing mechanism for closing the scoops after the user has released the inner control frame.

DETAILED DESCRIPTION OF PREFERRED EMBODIMENT

Figure 1:
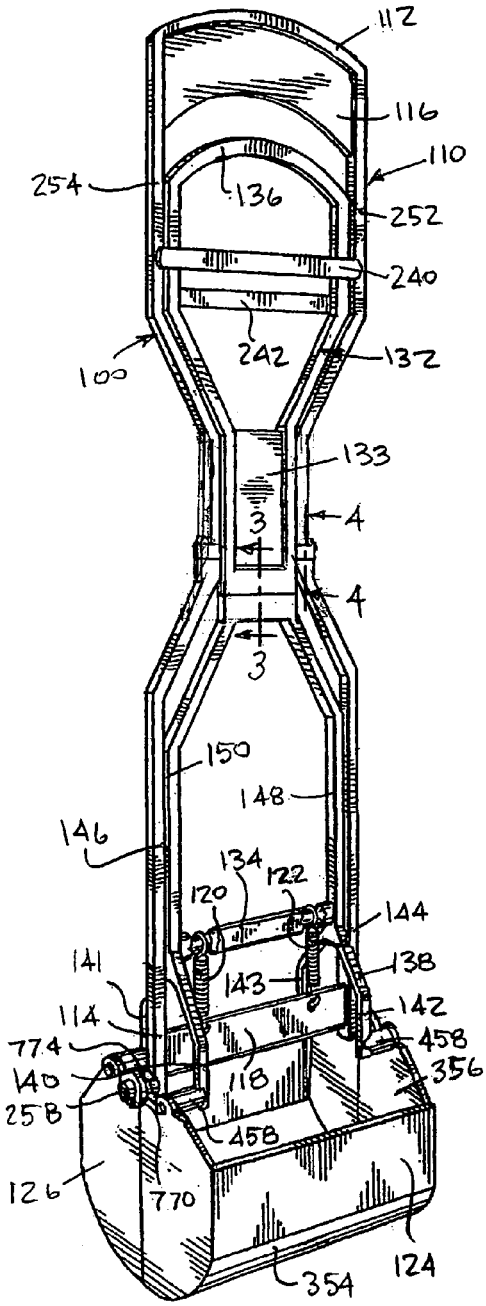
FIG. 1 is a perspective view of the litter retrieval device of the present invention in a closed position.

FIG. 1 is a perspective view of a preferred embodiment of the present invention. Referring to FIG. 1, an elongated outer frame 110 is provided having a handle end 112 and a scoop end 114. Two scoops 124 and 126 are pivotally connected to the scoop end 114 of the outer frame 110 by means of outer nipples 774. The outer frame 110 includes an outer brace 118 extending from a first vertical side 144 to a second vertical side 146 for strengthening its scoop end 114 and for securing the lower end of two biasing springs 120 and 122 thereto.

Carried by the outer frame 110 and aligned therewith is an elongated inner control frame 132 having a handle end 136 and a scoop end 138. The inner frame 132 includes an inner brace 134 extending from a first inner vertical side 148 to a second inner vertical side 150 for strengthening the scoop end 138 and for securing the upper end of the two biasing springs 120 and 122.

A rectangular portion 133 is also preferably provided between the first inner vertical side 148 and the second inner vertical side 150 at the central portion of the inner control frame 132 for providing additional strength to the inner control frame 132.

Included at the scoop end 138 of the inner control frame 132 is a pair of linkage arms 140 and 141 for flexibly and pivotally connecting one side of each scoop 124 and 126 to one side of the inner control frame 132. A second pair of linkage arms 142 and 143 is provided for flexibly and pivotally connecting the other side of each scoop 124 and 126 to the other side of the inner control frame.

The inner control frame 132 can be moved upwardly against the force of biasing springs 120 and 122, until the handle end 136 of the inner control frame 132 meets a stop portion 116 of outer frame 112.

The entire retrieval device, except for the biasing springs 120 and 122, is preferably made from a hard plastic material with the linkage arms 140, 141, 142, and 143 at least slightly flexible. The device is therefore inexpensive to manufacture, yet strong so that is it not easily broken. Further, the plastic material can be easily cleaned.

The inner control frame 132 maintains its alignment within the outer frame 110 by means of first and second alignment members 240 and 242 extending between both sides of the outer frame 110. As shown, the first alignment member 240 is attached to the front of two top vertical members 252 and 254 of the outer frame 110, while the second alignment members are similarly attached to the rear.

The linkage arms 142 and 143 connect the inner control frame 132 and the scoops 124 and 126. The linkage arms 142 and 143 outwardly and downwardly extend in an acute angle for a distance from the inner control frame 132, in opposite directions and are preferably integral with the inner control frame 132. The two linkage arms 142 and 143 then extend vertically for a short distance so that each linkage arm 142 and 143 can be pivotally connected to a scoop, linkage arm 142 being connected to the right end of scoop 126 and linkage arm 143 being connected to the right end of the scoop 124. Linkage arms 140 and 141 (shown in FIG. 1) are similarly connected to the left end of scoops 124 and 126 respectively.

The scoops 124 and 126 are formed to mate with each other so that they form a container having a closed bottom 354 and an open top 356. The scoops 124 and 126 are connected at central pivot points 258 that also connect both scoops 124 and 126 to the outer frame 110. When a user pulls inner control frame 132 upwardly toward the stop portion 116, the linkage arms 142 and 143 cause the scoops 124 and 126 to pivot in opposite directions, opening the bottom portion 354. The structure and operation is fully described in U.S. Pat. No. 5,601,321.

According to the invention, the outer frame 110 and the inner frame 132 are each divided into upper and lower portions which can be connected together to form the assembled retrieval device. This enables the device to be packaged in a smaller package and thus occupy less shelf space when it is sold.

Figure 2:
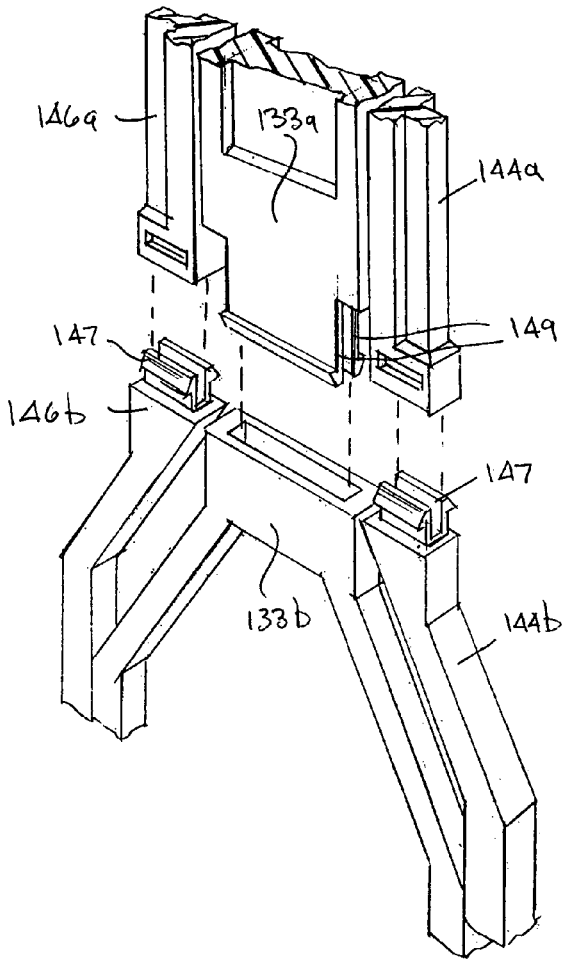
FIG. 2 is an exploded perspective view showing how the upper and lower portions of their respective inner and outer frame members are assembled.
Figure 4:
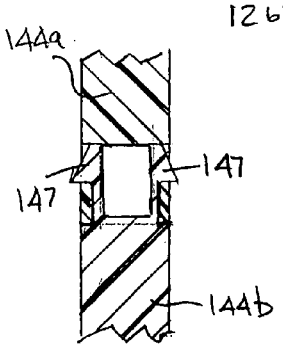
FIG. 4 is a sectional view taken along the line 4—4 of FIG. 1, illustrating the connection between a scoop portion and frames of the present invention.

Specifically, referring to FIG. 2, the vertical sides 144 and 146 of outer frame 110 include upper and lower portions 144*a*, 144*b* and 146*a*, 146*b*. The lower portions 144*b* and 146*b* include integrally molded resilient prongs 147 which can be snap fit into the open bottom portions of the legs 144*a* and 146*a* (FIG. 4) to assemble a complete outer frame.

Figure 3:
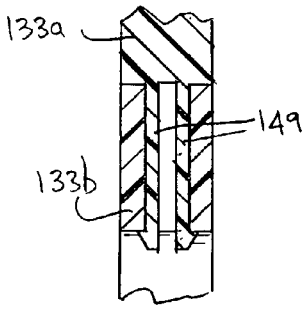
FIG. 3 is a sectional view taken along lines 3—3 of FIG. 1.

Likewise, the rectangular portion 133 of the inner control frame 132 includes an upper section 133*a* and a lower section 133*b*. In this case, it is the upper section 133*a* which includes prongs 149, integrally molded therewith, which are adapted to be latched into place within an opening in the lower portion 133*b* (FIG. 3). This arrangement enables the refuse retrieval device to be sold in two separate parts. The parts can be packaged side by side so that the overall length of the required package is about half of what would be required if it was necessary to package the fully assembled device.

While the present invention has been particularly shown and described with reference to preferred embodiments thereof, it will be understood by those skilled in the art that various changes in form from the spirit and scope of the invention.

What is claimed is:

1. A frame for a refuse retrieval device comprising:

an upper end of said frame and a lower end of said frame;

said lower end of said frame including refuse retrieval scoop means;

the frame including an outer frame member having at least one outer frame upper portion and at least one outer frame lower portion;

at least one outer prong disposed on one of said at least one outer frame upper portion and said at least one outer frame lower portion;

at least one prong receiving opening disposed on the other of said at least one outer frame upper portion and said at least one outer frame lower portion opposite said prong;

the frame further including an inner frame member having at least one inner frame upper section and at least one inner frame lower section;

at least one inner prong disposed on one of said at least one inner frame upper section and said at least one inner frame lower section;

at least one prong receiving opening disposed on the other of said at least one inner frame upper section and said at least one inner frame lower section opposite said prong; and wherein at least one of the inner and outer frame is movable with respect to the other frame.

2. The refuse retrieval device of claim 1 wherein when said at least one outer prong is disposed on said lower portion of said outer frame, at least one inner prong is disposed on said upper section of said inner frame.

3. The refuse retrieval device of claim 1, wherein said at least one outer prong is integrally formed with said outer frame.

4. The refuse retrieval device of claim 1, wherein said at least one inner prong is integrally formed with said inner frame.

5. The frame for a refuse retrieval device of claim 1, wherein said at least one outer prong includes two prongs disposed on opposite sides of the lower portion of the outer frame.

6. A refuse retrieval device comprising:

an outer frame member and an inner frame member wherein at least one of the inner and outer frame is movable with respect to the other frame;

said outer and inner frame members adapted to cooperate with one another and being connected to form a frame having an upper end and a lower end;

refuse retrieval scoop means connected to said refuse retrieval device at the lower end of said frame;

said outer frame member comprising:

at least one outer frame upper portion and at least one outer frame lower portion;

at least one prong disposed on one of said at least one outer frame upper portion and said at least one outer frame lower portion;

at least one prong receiving opening disposed on the other of said at least one outer frame upper portion and said at least one outer frame lower portion opposite said prong;

whereby the upper and lower portions of the frame can be locked together by engagement of said prong and prong receiving opening;

said inner frame member comprising:

at least one inner frame upper section and at least one inner frame lower section;

at least one prong disposed on one of said at least one inner frame upper section and said at least one inner frame lower section;

at least one prong receiving opening disposed on the other of said at least one inner frame upper section and said at least one inner frame lower section opposite said prong; and whereby the upper and lower sections of the frame can be locked together by engagement of said prong and prong receiving opening.

7. A refuse retrieval device comprising:

an outer frame member comprising:

at least one upper portion and at least one lower portion;

at least one prong disposed on one of said at least one upper portion and said at least one lower portion;

at least one prong receiving opening disposed on one of said at least one upper portion and said at least one lower portion opposite said prong;

whereby the upper and lower portions of the frame can be locked together by engagement of said prong and prong receiving opening;

an inner frame member comprising:

at least one upper section and at least one lower section;

at least one prong disposed on one of said at least one upper section and said at least one lower section;

at least one prong receiving opening disposed on one of said at least one upper section and said at least one lower section opposite said prong;

whereby the upper and lower sections of the frame can be locked together by engagement of said prong and prong receiving opening;

said outer frame member further including a handle at one end and mounting means at another end;

said inner frame member carried by the outer frame member having a handle at one end and two pair of linkage arms at another end, said linkage arms integrally formed with said inner frame member.

a scoop means having a first end and a second end, said first end and said second end being pivotally mounted on said mounting means, each end of the scoop means also pivotally connected to one pair of the linkage arms;

a spring biasing mechanism connected to said inner frame member and said outer frame member for biasing the scoop means in a closed position, said spring biasing member comprising:

a first brace connected to between a first and second side of said inner frame member;

a second brace connected to between a first and second side of said outer frame member; and a pair of springs connected between the first brace and the second brace with one of the springs being substantially parallel to the other;

alignment means connected to said outer frame member for aligning the inner frame member with said outer frame member; and said scoop means having a pair of scoops and an extended portion at each end, each extended portion having a hole therethrough for mounting on the mounting means, the extended portions of each scoop overlappingly positioned with the extended portions of the other scoop so that the hole in each extended portion at each end of one scoop is in alignment with a corresponding hole in the extended portion at each end of the other scoop.

* * * * *